US005560519A

United States Patent [19]

Moore et al.

[11] Patent Number: 5,560,519

[45] Date of Patent: Oct. 1, 1996

[54] DISPENSERS AND DISPENSER ARRAYS FOR DISPLAYING AND DISPENSING BULK GOODS

[75] Inventors: Malcolm A. Moore, Foxboro, Mass.; Robert H. Schmidt, Dayville, Conn.

[73] Assignee: Clearview Industries, Inc., Sharon, Mass.

[21] Appl. No.: 179,185

[22] Filed: Jan. 10, 1994

[51] Int. Cl.[6] ..... B67D 5/06

[52] U.S. Cl. ..... 222/129; 222/130; 222/153.03; 222/153.14; 222/155; 222/185.1; 222/357; 222/561; 292/302

[58] Field of Search ..... 222/153, 183, 222/185, 181, 113, 356, 357, 561, 129, 156, 157, 158, 131, 130, 185.1, 153.02, 153.03, 153.14, 153.01, 155; 40/312, 324, 406, 409; 292/207, 208, 383, 384, 302

[56] References Cited

U.S. PATENT DOCUMENTS

| | | | |
|---|---|---|---|
| 548,534 | 10/1895 | Foster et al. | 222/153 X |
| 1,876,332 | 9/1932 | Mabey | 222/113 |
| 1,925,056 | 8/1933 | Pepper | 222/153 X |
| 2,099,155 | 11/1937 | Weber | 40/406 |
| 2,562,212 | 7/1951 | Rogers et al. | 222/113 |
| 3,071,888 | 1/1963 | Knott | 40/406 X |
| 4,562,941 | 1/1986 | Sanfilippo | 222/181 X |
| 4,650,098 | 3/1987 | Ellis et al. | 222/357 X |
| 5,029,701 | 7/1991 | Roth et al. | 206/232 |
| 5,105,991 | 4/1992 | Johnson | 222/185 |
| 5,437,393 | 8/1995 | Blicher et al. | 222/185.1 X |

FOREIGN PATENT DOCUMENTS

| | | | |
|---|---|---|---|
| 2219279 | 12/1989 | United Kingdom | 222/185 |

*Primary Examiner*—Kevin P. Shaver
*Attorney, Agent, or Firm*—F. Eugene Davis, IV

[57] ABSTRACT

Each dispenser, which may be used for candy, is identical except for a identically sized top rectangular panel. The back, bottom, front, and a baffle are formed of one piece of thermoplastic material. A right angle bent is adhered to the top of the baffle. The top panels for a top row of dispensers are adhered to the dispensers and each has a hole communicating with a cylindrical reservoir. Those for a bottom row are hinged to the back. All sides are identical. Depending chutes are rectangular and have a sliding door. The sliding doors and the bent each have identical cylinders adhered to them. The walls of each chute have holes aligned with its cylinder. The hinged tops have a hole through which a cylinder protrudes. A locking cable has a large finial at one end and a small finial at the other. Two washers are provided that fit over the large finial, but not the smaller. A washer is threaded against the large finial and the cable passed through aligned cylinders. The second washer is threaded onto the cable and the hasp of a padlock passed through it so it cannot be passed over the smaller finial to provide a lock for aligned chutes or aligned tops. The cylindrical reservoirs are double walled and the spaces between them are filled to display the product. Only the inner cylinder feeds to its dispenser to provide an additional supply. All dispenser parts and the outer reservoir cylinder are transparent plastic for display of the product.

25 Claims, 7 Drawing Sheets

DISPENSERS AND DISPENSER ARRAYS FOR DISPLAYING AND DISPENSING BULK GOODS

TECHNICAL FIELD

This invention relates to dispensers and dispenser arrays for displaying and dispensing bulk goods such as candy in a candy store or theater.

BACKGROUND ART

It is a growing trend for supermarkets and especialty stores to feature displays of bulk foods in which the customer is permitted to select and package a desired quantity of goods. Thus, the customer is permitted to selectively purchase goods so that the customer receives the feeling that he has purchased the best or freshest possible goods. A further advantage is that the customer is liberated from the weight and freshness limitations of packaged food products. A still further advantage is that by allowing the customer to serve himself, there is no need for an employee to package and stack such packaged goods so that the store limits its overhead costs, which savings may be passed on to customers.

It has also been found that allowing the customer in a theater to dispense any quantity he or she chooses from a display greatly increases sales of candy.

Prior art display dispensers of this type are disclosed in U.S. Pat. Nos. 4,718,578, 4,889,263, and 5,105,991; and in British Patent Application No. GB 2,219,279A.

It has been found that these display dispensers have several disadvantages. Among them are the following:

A multiplicity of small parts are required to construct a dispenser;

The dispensing chutes' closures are complicated, hard to use, and cause spillage;

The dispensers, when disposed in two rows one above the other, are constructed of distinctly different parts;

The dispensers use parts that may be removed by unauthorized persons;

The dispensers may be opened and product removed by unauthorized persons;

The dispensers may not be secured when not in use against unauthorized dispensing or entry.

Vertically oriented reservoirs above the dispensers present a poor appearance when not full.

DISCLOSURE OF THE INVENTION

Each dispenser has identical rear, bottom and front walls, and a baffle depending from the rear of the front wall. All of these are formed from an integral piece of transparent thermoplastic polymer. The front and bottom walls are angled down and up, respectively meeting at an acute angle.

Identical side panels are adhered to the integral piece and have corner notches at the bottom so that the dispenser may be mounted on a pair of parallel rails.

All of the tops are formed of rectangular pieces having identical dimensions. Usually, in use at least two rows of dispensers are mounted on two pairs of rails, one above the other. The tops of the top bins are permanently adhered to the integral piece and have a hole in them.

All of the tops of the bottom row of dispensers are hinged to their respective back wall.

Identical chutes are provided depending from the upwardly angled bottom wall portions. The chutes are rectangular and have a slot in their top wall and slots inside their side walls to receive and guide a sliding door.

A hole in the extreme front of each dispenser allows a rake to be manipulated to pull candy into its chute.

In order to lock the chutes, aligned holes are provided in the side walls, and a cylinder of the same inner dimension is affixed to the outside of each of the sliding doors. A locking cable, chain, or rod may be placed through the holes in all of the chutes and the cylinder affixed to the sliding doors to lock them.

In order to lock the hinged tops, a right angle bent is adhered to the baffle at the top thereof. A cylinder identical to the cylinders adhered to the sliding doors is adhered to the top of the bent and fits through a hole in the hinged top. Another locking cable, chain or rod may be fitted through these cylinders to lock the hinged tops.

Identical bents are used to support the fixed tops. Then all dispensers are identical except the top row has fixed tops with holes and the bottom row has hinged tops.

All of the parts of the dispenser are preferably made of the same transparent thermoplastic which may be acrylic.

The bottom row of dispensers are used for slow selling items and must be refilled by hand.

The top row of dispensers are used for fast selling items. Cylindrical external storage bins are located above the openings in the top bins and provide additional storage. The cylindrical storage bins comprise an outer cylinder of the same transparent plastic material as the dispensers and an inner cylinder that may or may not be transparent. The bottom between the two cylinders is closed to allow the space between them to be filled with the candy to be dispensed. This is for display only and is always full. The inner cylinder communicates with the opening in the top of the dispenser to feed its contents into the dispenser by gravity.

A convenient locking mechanism comprises three identical cables, each having a large diameter and a small diameter finial attached at each end. A first washer has a hole that fits over the small finial, but not the larger one. It is placed on the cable against the larger finial. The cable is threaded through a row of aligned cylinders. A second washer which may be identical is fitted over the small finial onto the cable and the hasp of a padlock is fitted through the opening in the second washer. This prevents the smaller finial from now passing through the second washer. The washers are bigger in diameter than the cylinders, thus locking all of the chutes or tops engaged.

OBJECTS OF THE INVENTION

It is therefore an object of the invention to provide improved dispensers and dispenser arrays for displaying and dispensing bulk goods.

Another object of the invention is to provide such dispensers utilizing a minimum number of parts.

A further object of the invention is to provide such dispensers having a simple, easy to operate and spillage resistant chute closure.

Yet another object of the invention is to provide such dispensers requiring only one part change when used with a vertically disposed reservoir.

Yet a further object of the invention is to provide such dispensers in which parts may not be removed by unauthorized persons.

Still another object of the invention is to provide such dispensers which may not be opened by unauthorized persons.

Still a further object of the invention is to provide such a dispenser secured when not in use against unauthorized dispensing or entry.

Yet still another object of the invention is to provide such dispensers that may be easily and inexpensively manufactured from thermoplastic polymer sheets and tubes.

Yet still a further object of the invention is to provide a simple, inexpensive, easily manufactured, and easily used locking device for such dispensers.

Another further object of the invention is to provide vertically oriented reservoirs for such dispensers that present a neat, full appearance at all times.

Other objects of the invention will in part be obvious and will in part appear below.

The invention accordingly comprises articles of manufacture and products possessing the features, properties, and the relation of elements and components which will be exemplified in the articles described herein. The scope of the invention is indicated in the claims.

BRIEF DESCRIPTION OF THE DRAWINGS

For a fuller understanding of the nature and objects of the invention, reference should be had to the following detailed description taken in connection with the accompanying drawings, in which.

The same reference characters refer to the same elements throughout the several views of the drawings.

DETAILED DISCLOSURE OF THE INVENTION

Figure 12:
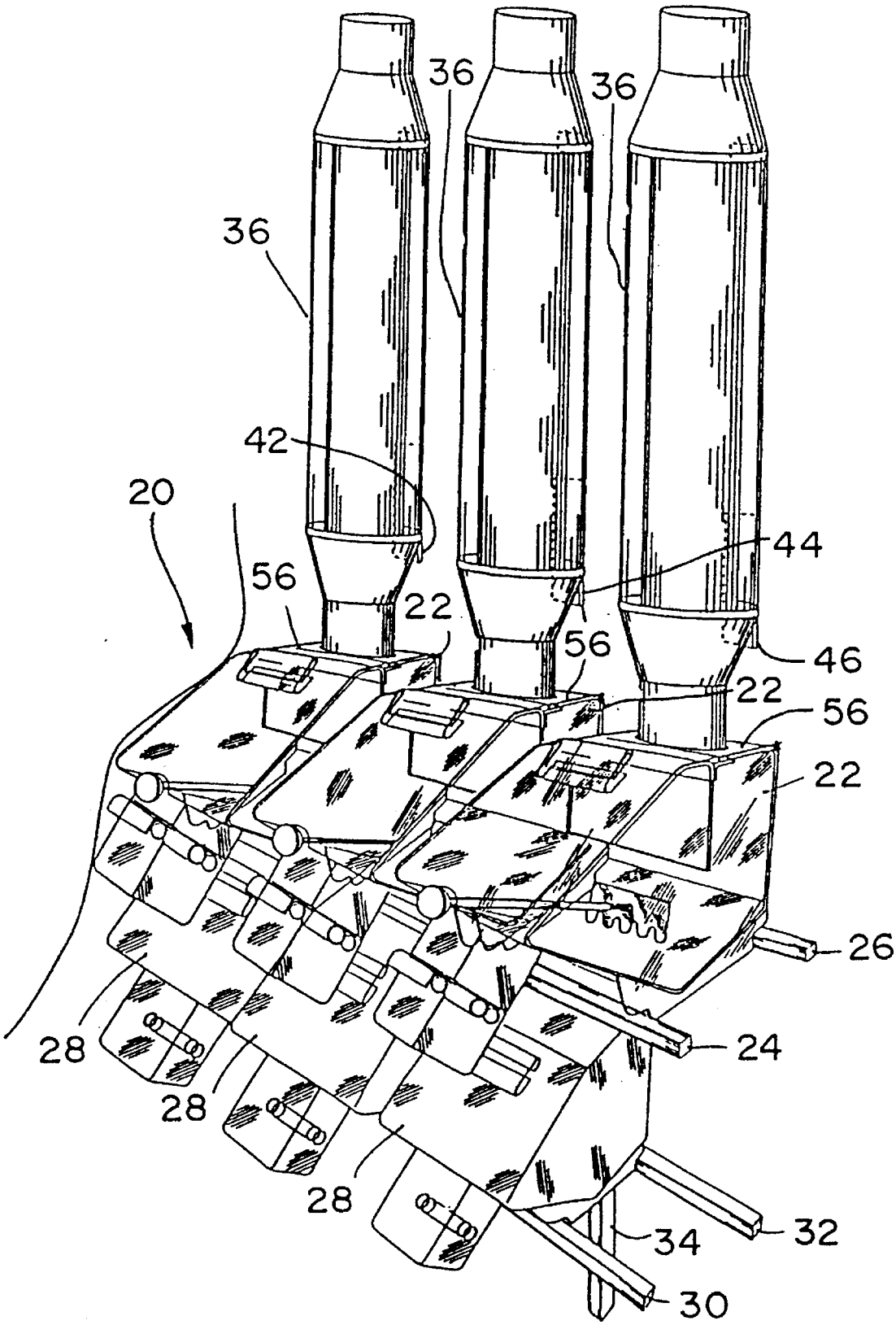
FIG. 12 is a perspective view of a two row array of dispensers according to the invention and showing the locking mechanisms employed.

Now, referring to the drawings and particularly to FIG. 12, an array of candy display dispensers according to the invention is generally indicated at 20. It consists of a plurality of identical upper row bins 22 sitting on rails 24 and 26 and a plurality of identical lower row bins 28 sitting on lower rails 30 and 32.

The rails 24, 26, 30, and 32 may be arranged on frames (not shown) attached to one or more vertical rails 34 which may be attached to a wall. Also attached to the wall are a plurality of identical display reservoirs 36 which feed into the upper bins 22; they may be attached to the wall by brackets 42, 44, and 46.

Figure 1:
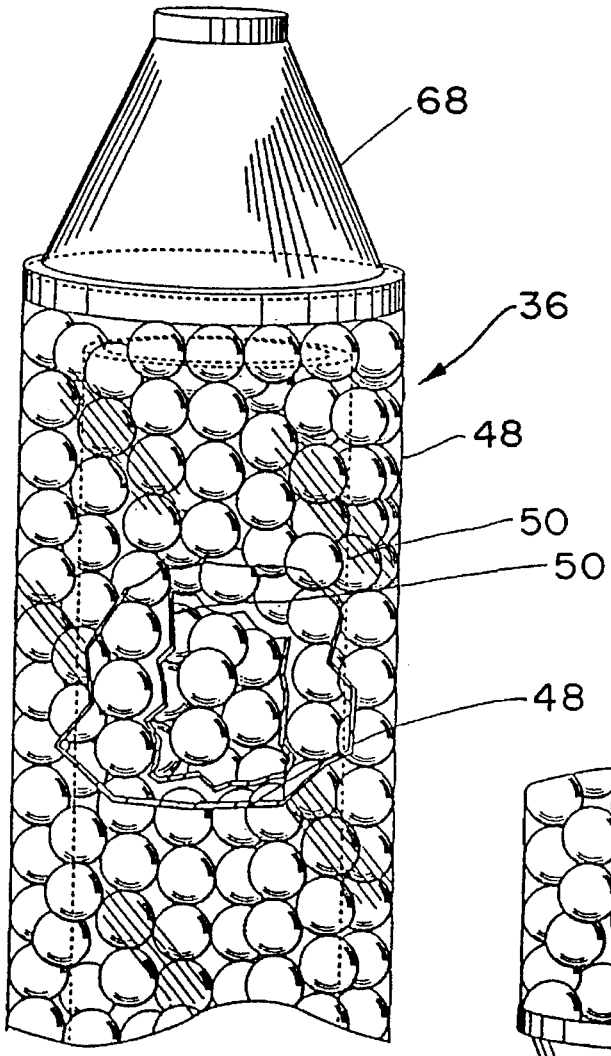
FIG. 1 is a partial elevational view of the top portion of a vertically oriented reservoir according to the invention.
Figure 2:
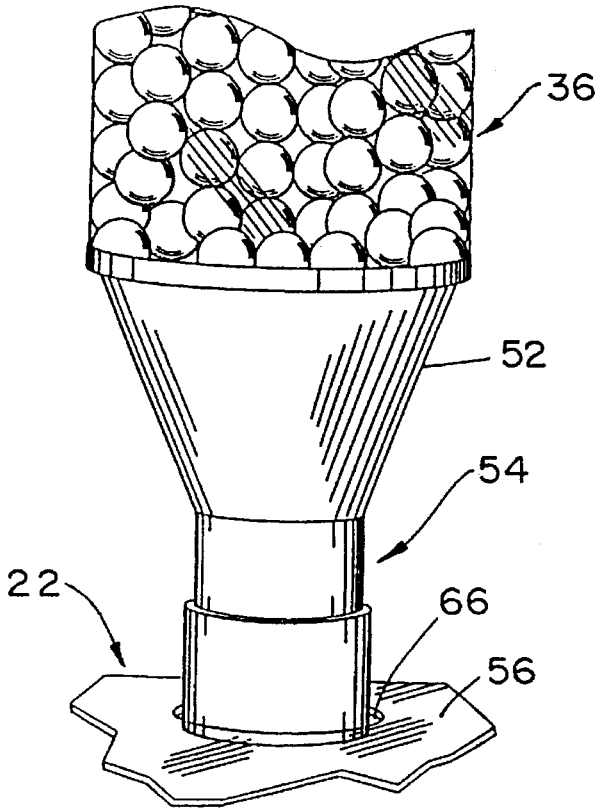
FIG. 2 is a partial elevational view of the bottom portion of the reservoir of FIG. 1.

As shown in FIGS. 1 and 2, the reservoirs 36 comprise an outer transparent cylindrical wall 48 and an inner wall 50 which may be transparent, but preferably is opaque. The space at the bottom between the walls 48 and 50 is closed so that candy may be placed therein for permanent display. The inner cylinder 50 opens into funnel 52 terminating in a cylindrical portion, generally indicated at 54, leading into the top 56 of a bin 22.

Figure 3:
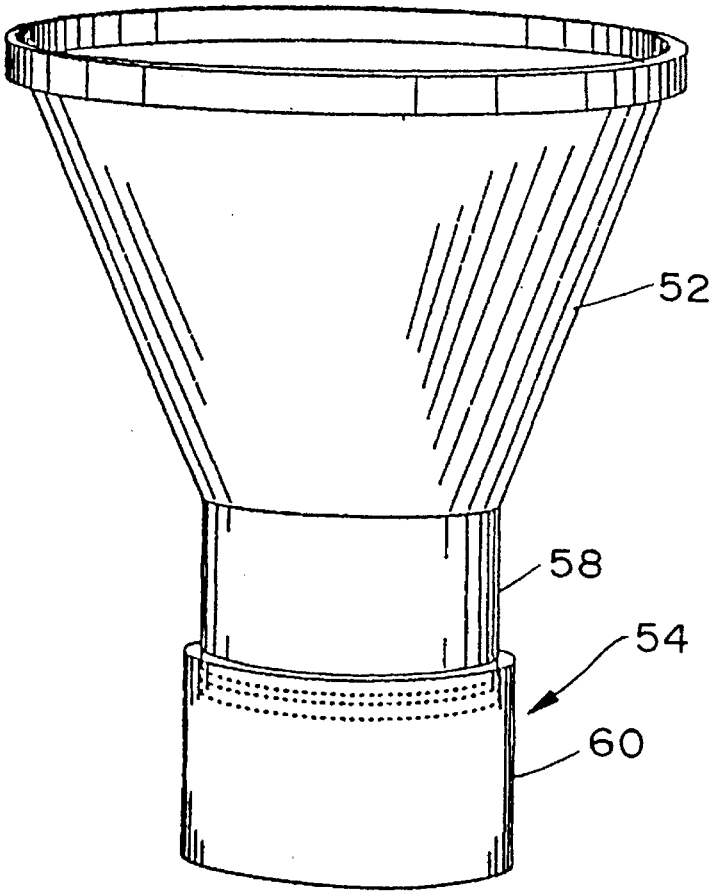
FIG. 3 is an enlarged view of a portion of the reservoir shown in FIG. 2.
Figure 4:
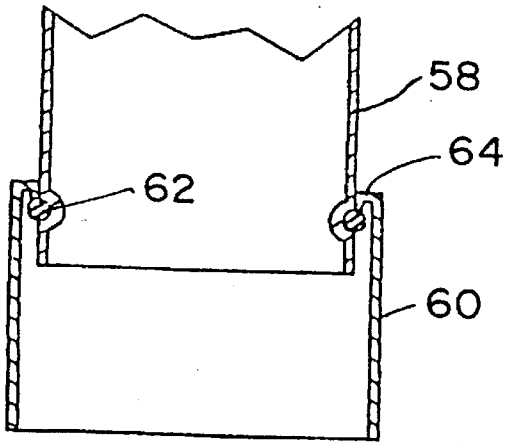
FIG. 4 is a partial cross sectional view, partially cut away of the portion shown in FIG. 3.

As best shown in FIGS. 3 and 4, the cylindrical portion 54 comprises an upper portion 58 and a lower portion 60. Upper portion 58 has an "O" ring 62 at the bottom thereof and lower portion 60 has an inwardly depending flange 64 at the upper portion thereof which prevent the lower portion 60 of the cylinder from falling through the opening 66 in the top 56 (FIG. 2).

As seen in FIG. 1, a decorative top 68 fits over the reservoir 36.

Figure 5:
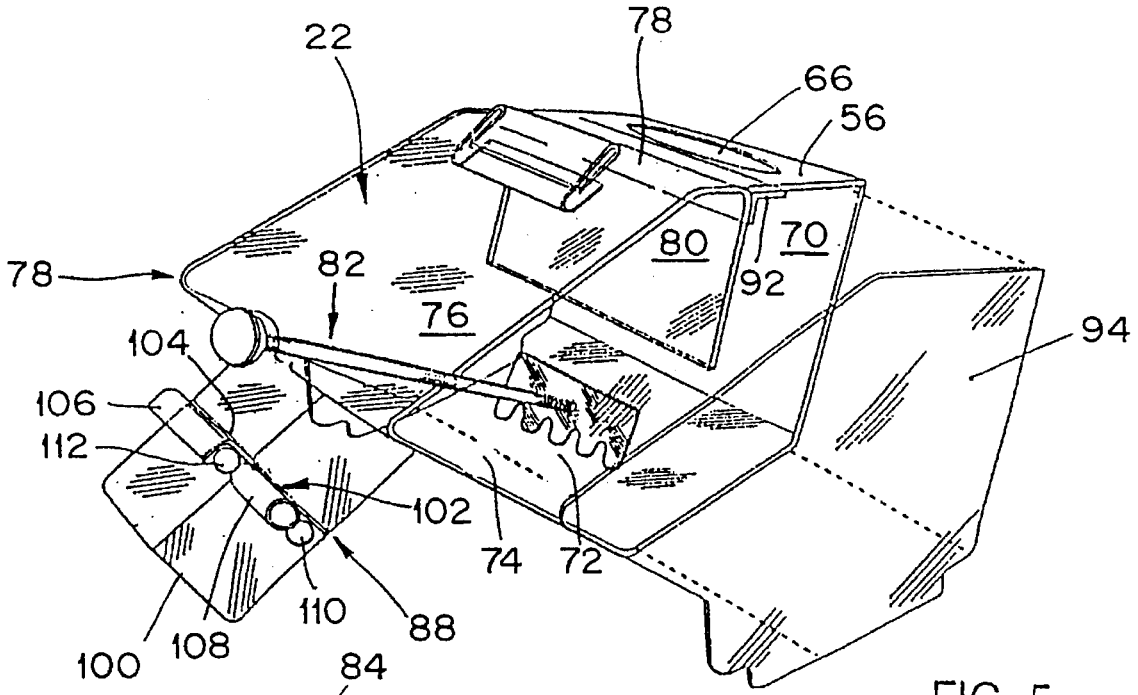
FIG. 5 is a diagrammatic perspective view showing how a dispenser according to the invention may be assembled.
Figure 6:
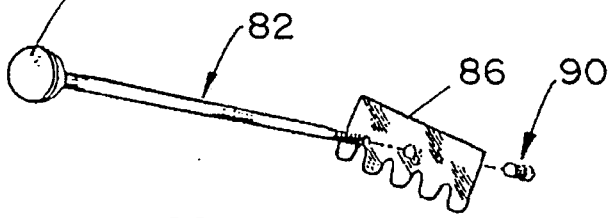
FIG. 6 is a perspective view showing how a rake according to the invention may be assembled.
Figure 7:
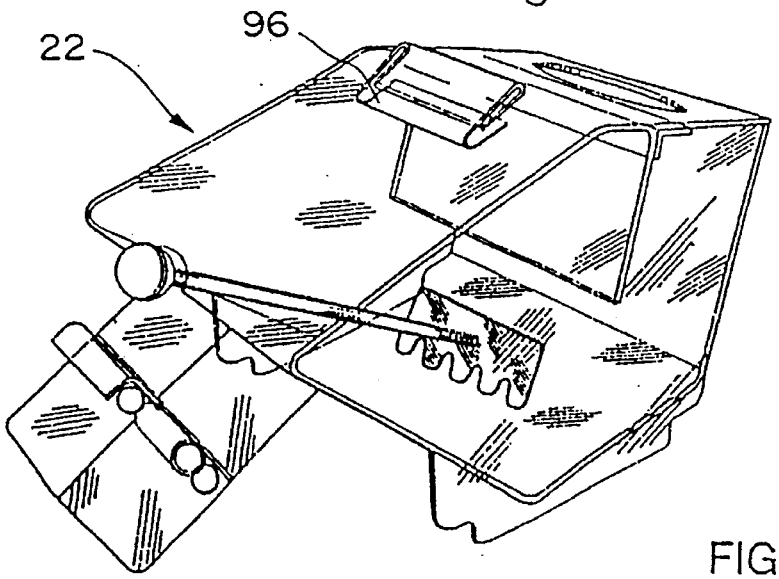
FIG. 7 is a perspective view similar to FIG. 5 showing an assembled top row dispenser according to the invention.

Now referring to FIGS. 5, 6, and 7, in which a top bin 22 is shown in detail. It comprises a back wall 70, a bottom wall 72, a portion 74 of which slopes upwardly and a front wall 76, a portion of which slopes downwardly meeting at an acute angle, generally indicated at 78. The back wall 70, bottom wall 72, portion 74, and front wall 76 are formed of an integral piece of thermoplastic preferably polyacrylate, and the front wall 76 continues into a top portion 78, and a depending baffle portion 80 insuring a void in front of the baffle 80 above the candy to be dispensed.

A rake, generally indicated at 82, may be manipulated by knob 84 to cause the rake portion 86 to rake product towards a chute, generally indicated at 88. The rake 82 is assembled inside the dispenser 56 utilizing a screw 90 shown in FIG. 6.

An angle piece or bent 92 is adhered to the upper portion of the baffle 80 and the top plate 56 having opening 66 is then adhered to the upper surface of angle or bent 92 and adhered in a butt joint to the rear wall 70. Identical side wall pieces 94 are then adhered to the sides to close the container and a folded piece of the same plastic material 96 is adhered to the upper surface 76 of the front of the container 22.

The chute 88 is open at the end thereof 100 and is closed by a sliding door, generally indicated at 102. It consists of a flat sheet of the transparent material of the dispenser 20 which slides up and down in a slot 104 by means of handle portion 106. Its motion is limited by a cylindrical pipe 108 which is permanently adhered to the door 102. When the door 102 is closed, the pipe 108 is aligned with a pair of holes 110 and 112 so that a locking mechanism may be inserted through holes 110 and 112 and pipe 108, as explained below.

Figure 11A:
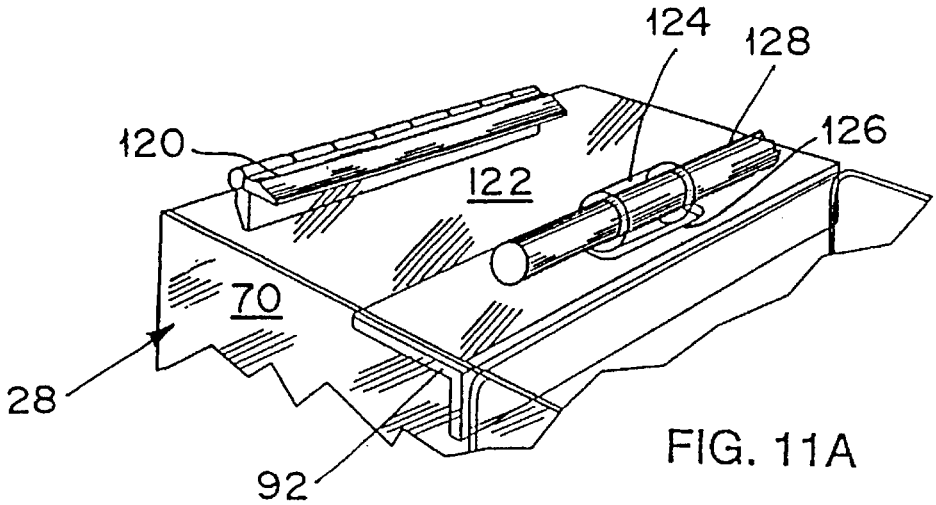
FIGS. 11A, 11B and 11C are perspective views, partially cut away, showing the hinged lid and locking mechanism therefor of a bottom row dispenser according to the invention.
Figure 11B:
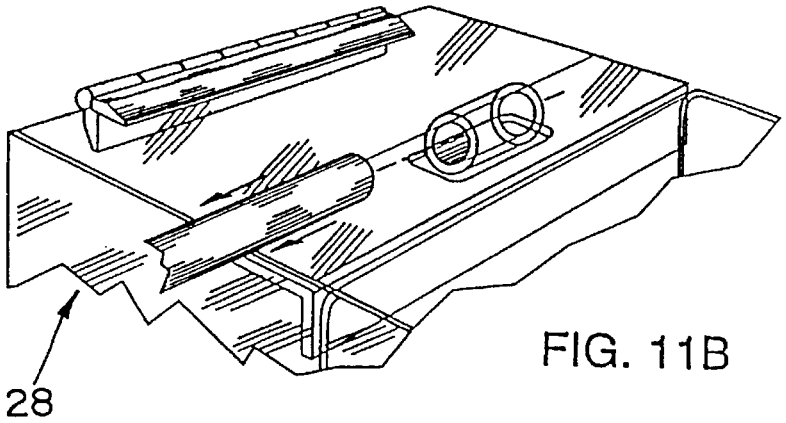
Figure 11C:
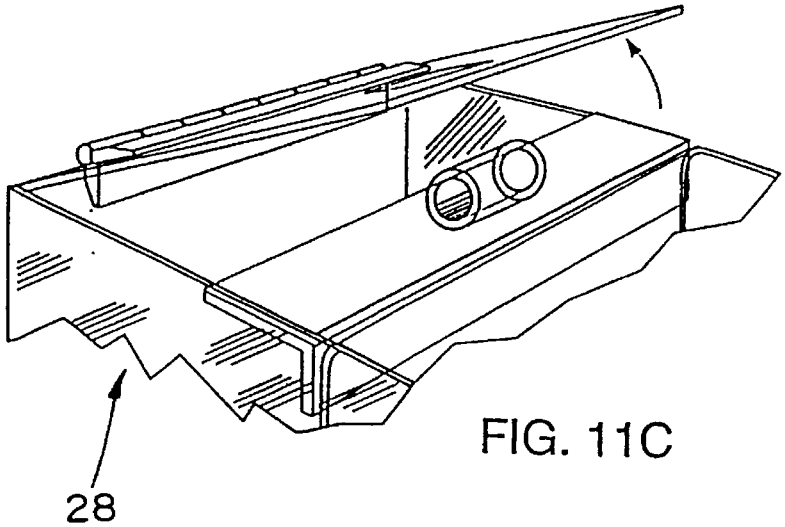

A lower row of bin 28 is shown in FIGS. 11A, 11B, and 11C. It is identical to the upper bins 22, except for the top 122 thereof, which, rather than being permanently affixed and closed, is hinged at hinge 120 which is adhered to the back wall 70 and top 122 so that the top may be opened and closed. The front portion of the top 122 will then close resting on the angle or bent 92. In order to lock the top 22, a cylindrical pipe 124 of the same material as the pipe 108 in FIG. 5 and of the same size is permanently adhered to the bent 92 and passes through an opening 126 in the top 122 when the top is open. The top may be closed by a rod, cable, or chain 128 passing through the cylinder 124 in the same way that the chute 88 of FIG. 5 may be locked closed by passing a rod, cable, or chain through the holes 106, 110, and identical cylindrical piece 108.

Thus, referring to FIGS. 5 through 7, and 11A, 11B, and 11C, every display dispenser bin 22 or 28 comprises a single piece forming the rear, bottom, front, and baffle; two identical side portions 94; identical chutes 88; identical closure means 102, and a locking means 108. The only difference between the display dispensers used in the top and bottom rows shown in FIG. 12, are that the top row bins 22 have permanently affixed tops 56 having circular openings 66 therein while the bottom display dispenser bins have a hinged top 122 as shown in FIGS. 11A, 11B, and 11C and an identical cylinder locking means 124 identical to the cylinder 108 of the chutes. The tops 122 and 56 are exactly the same size and shape.

Thus, savings are achieved in inventory, in cutting material, and the like by this commonality of parts.

Figure 8:
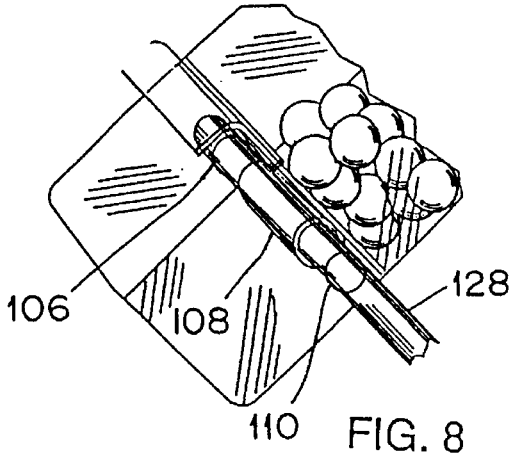
FIG. 8 is a partial perspective view, partially cut away, of the chute closure assembly of the dispenser of FIGS. 5 and 7.
Figure 9:
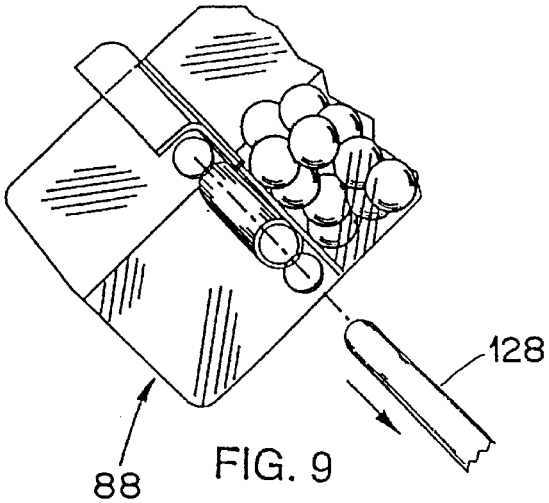
FIG. 9 is a perspective view similar to FIG. 8 showing operation of the chute locking mechanism according to the invention.
Figure 10:
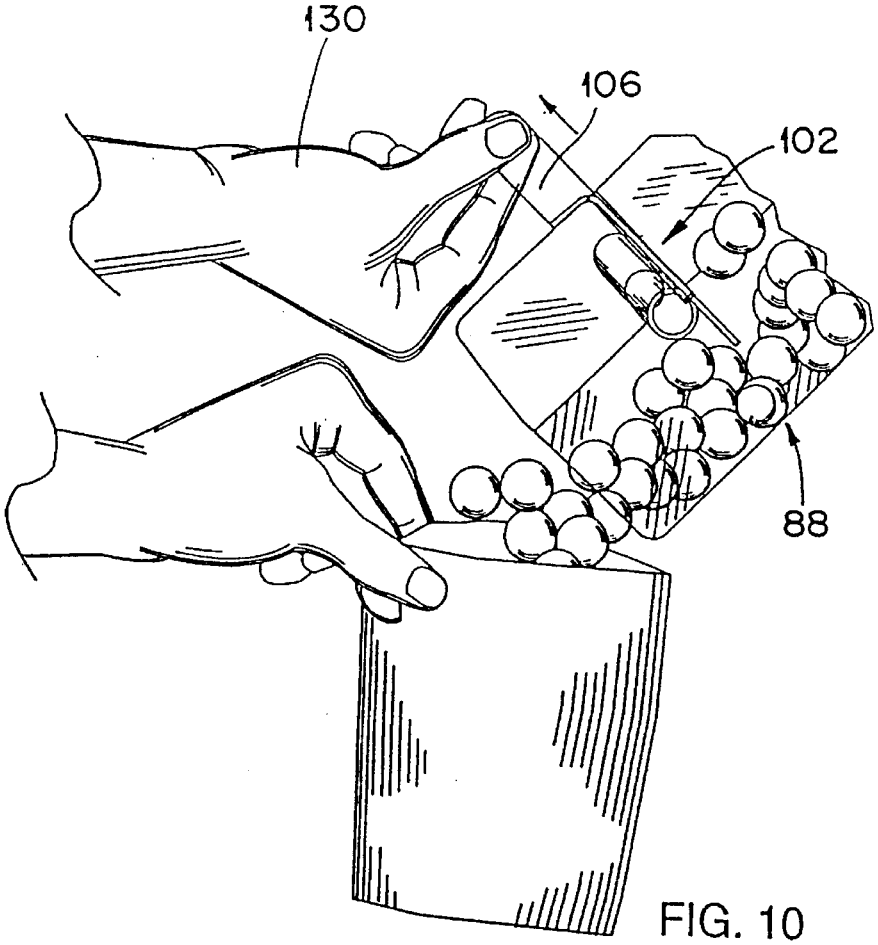
FIG. 10 is a perspective view, similar to FIGS. 7 and 8 showing how product is dispensed.

Now referring to FIGS. 8, 9, and 10, it can be seen how the candy, once raked into the chute, may be dispensed by pulling the closure 102 using the hand 130, pulling the handle portion 106, and may be locked by placing a rod, chain, or cable 128 through the holes 110 and 106 and the cylinder 108.

Figure 13:
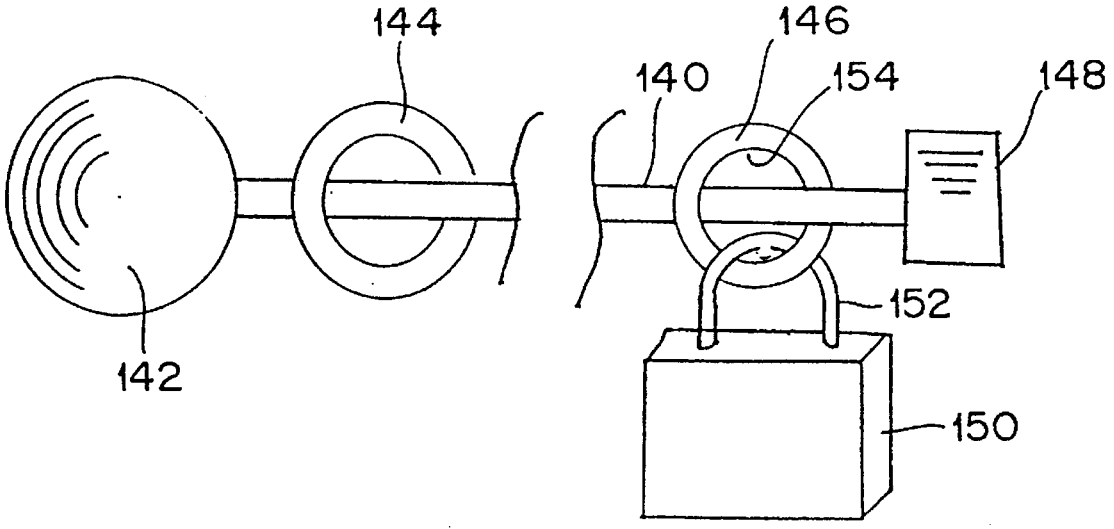
FIG. 13 is an elevational view, partially cut away, of the locking mechanism of FIG. 12.

A preferred locking mechanism is illustrated in FIG. 13. It comprises a cable 140 which may be of steel to which a steel finial 142 is permanently affixed by welding, brazing, swaging or the like. A first washer 144, a second washer 146, a second finial 148 of a smaller diameter than finial 142, and padlock 150 with the hasp 152 of padlock 150 passing through washer 146.

The finial 148 is small enough in diameter to fit through the tubes 108 and 124. The washer 144 and/or the finial 142 is too big to pass through the tubes 108 and 124. When the finial 148 is passed through all the tubes, the washer 146 fits over the finial 148 and then the hasp 152 of the padlock 150 is passed through washer 146 and the padlock closed. Now, the finial 148 will not pass through the opening 154 in the washer 146 and either a row of chutes or a row of tops will be locked closed.

It will thus be seen that the objects set forth above, among those made apparent from the preceding description, are efficiently attained and, since certain changes may be made in carrying out the above articles and products without departing from the scope of the invention, it is intended that all matter contained in the above description or shown in accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention, what we claim as new and desire to secure by Letters Patent is:

1. A dispenser for particulate solids comprising rear, bottom, and front walls, and an inner depending baffle, spaced between said front and rear walls, with said baffle at one end thereof; a shelf adjacent the top of said baffle; and a top wall affixed to said rear wall and lying on said shelf.

2. A dispenser as defined in claim 1 wherein said rear, bottom, and front walls and depending baffle are all formed of a single folded sheet of transparent material.

3. A dispenser as defined in claim 1 and a chute depending from the front wall thereof, said chute having a door adapted for opening and closing said chute.

4. A dispenser as defined in claim 3 wherein said chute has a slot therein for said door and guide means for guiding said door for sliding open and closed, and said loop-like member acting as a stop for said door preventing it from being removed from said slot.

5. A dispenser as defined in claim 4 wherein said stop comprises a loop-like member and aligned openings in said chute for passage of a locking member through said openings and said loop-like member when said door is in its closed position.

6. A dispenser as defined in claim 1 wherein said top wall is affixed to said shelf.

7. A dispenser as defined in claim 6 wherein said top wall has an opening therein for receiving the bottom of a storage container for material to be dispensed.

8. A dispenser as defined in claim 7 and a cylindrical storage chute located above said opening comprising a pair of upright cylinders one inside the other, the inner cylinder opening at its lower end into said opening in said top wall and the space between said cylinders being closed at the bottom thereof.

9. A dispenser as defined in claim 8 wherein said cylinders are axially aligned right-circular cylinders.

10. A dispenser as defined in claim 3 and a loop-like member affixed to said door facing out of said dispenser and openings in said chute aligned with said member when said door is in its closed position adapted to receive a locking member.

11. A plurality of dispensers as defined in claim 10 arranged side by side and a locking member passing through each of said chutes and loop-like members of each of said dispensers.

12. A plurality of dispensers as defined in claim 11 wherein said locking member comprises a ridged rod.

13. A plurality of dispensers as defined in claim 11 wherein said locking member comprises a cable having a first and a second finial affixed to each end thereof, said first finial and said cable adapted to pass through each of said chutes and said loop-like members, said second finial adapted to not pass through said chutes.

14. A plurality of dispensers as defined in claim 13 and a washer adapted to fit over said first finial and said cable and not to pass through said chutes, and a lock having a part which when passed through said washer prevents said first finial from passing through said washer.

15. A plurality of dispensers as defined in claim 14 and a second washer through which said second finial is adapted not to pass through between said second finial and the first chute through which said cable has been passed.

16. A dispenser for particulate solids comprising rear, bottom, and front walls, and an inner depending baffle, spaced between said front and rear walls; all formed of a single folded sheet of transparent material with said baffle at one end thereof; and a top wall between said baffle and said rear wall, wherein said top wall is closed and hinged to said rear wall.

17. A dispenser as defined in claim 16 and a loop-like member affixed to said dispenser adapted to receive a locking member and an opening in said top wall adapted to allow access to said member above said top wall when said top is in its closed position.

18. A dispenser as defined in claim 16, an elongated member affixed adjacent the top of said baffle on which said top wall sits and a loop-like member affixed to said angular elongated member adapted to receive a locking member and an opening in said top wall adapted to allow access to said member above said top wall when in its closed position.

19. A plurality of dispensers as defined in claim 18 arranged side by side and a locking member passing through each of the loop-like members of each of said dispensers.

20. A plurality of dispensers as defined in claim 19 wherein said locking member comprises a rigid rod.

21. A plurality of dispensers as defined in claim 19 wherein said locking member comprises a cable having a first and a second finial affixed to each end thereof, said first finial and said cable adapted to pass through each of said loop-like members, said second finial adapted to not pass through said loop-like members.

22. A plurality of dispensers as defined in claim 21 and a washer adapted to fit over said first finial and said cable and not to pass through said loop-like member, and a lock having a part which when passed through said washer prevents said first finial from passing through said washer.

23. A plurality of dispensers as defined in claim 22 and a second washer through which said second finial is adapted not to pass through between said second finial and the first loop-like member through which said cable has been passed.

24. A dispenser for particulate solids comprising a vertically oriented cylindrical storage chute comprising a pair of cylinders, one inside the other, the bottom of the inner cylinder being open for dispensing particulate solids and the bottom of said outer cylinder being closed between it and said inner cylinder.

25. A dispenser as defined in claim 24 wherein said cylinders are axially aligned right-circular cylinders.

* * * * *